US008667747B2

(12) United States Patent
Repasky

(10) Patent No.: US 8,667,747 B2
(45) **Date of Patent: *Mar. 11, 2014**

(54) STABILIZING SYSTEM FOR DECK PEDESTALS

(76) Inventor: John Repasky, Hanover, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/032,995

(22) Filed: Feb. 23, 2011

(65) Prior Publication Data

US 2011/0138723 A1 Jun. 16, 2011

Related U.S. Application Data

(63) Continuation of application No. 12/417,942, filed on Apr. 3, 2009, now Pat. No. 8,381,461.

(51) Int. Cl.
*E04B 9/00* (2006.01)
*E04C 3/00* (2006.01)

(52) U.S. Cl.
USPC ..... 52/126.5; 52/836; 52/845

(58) Field of Classification Search
USPC ..... 52/835, 836, 838, 844, 845, 848, 854, 52/855, 638, 641, 645, 651.1, 695, 693, 52/126.1, 126.5, 126.6
See application file for complete search history.

(56) References Cited

U.S. PATENT DOCUMENTS 3,466,824 A * 9/1969 Troutner ..... 52/262
3,616,584 A * 11/1971 Sartori ..... 52/126.6
4,085,557 A * 4/1978 Tharp ..... 52/263
4,277,923 A * 7/1981 Rebentisch et al. ..... 52/126.6
4,417,426 A * 11/1983 Meng ..... 52/126.7
4,558,544 A 12/1985 Albrecht et al.
4,570,397 A 2/1986 Creske
4,736,555 A * 4/1988 Nagare et al. ..... 52/126.6
4,759,162 A 7/1988 Wyse
4,780,571 A * 10/1988 Huang ..... 174/484
4,996,804 A 3/1991 Naka et al.
5,333,423 A 8/1994 Propst
5,377,468 A 1/1995 Repasky
5,442,882 A 8/1995 Repasky
5,588,264 A 12/1996 Buzon
5,862,635 A * 1/1999 Linse et al. ..... 52/126.6
6,205,739 B1 * 3/2001 Newlin ..... 52/655.1
6,332,292 B1 12/2001 Buzon
6,363,685 B1 4/2002 Kugler
6,520,471 B2 2/2003 Jones et al.

(Continued)

OTHER PUBLICATIONS

Bison, "Bison Deck Supports ScrewJack B Series Specifications", pp. 1-4, Oct. 6, 2005.
Bison, "Bison ScrewJack B Series Pedestals", pp. 1-2, Sep. 30, 2005.
Elmich, "VersiJack", 9 pages, Oct. 9, 2006.
Wausau Tile, "Pedestal/Roof Deck System Components", (http://www.wausautile.com/paving/pedestalRoofDeckSystems.cfm) Apr. 3, 2009.

(Continued)

*Primary Examiner* — Jessica Laux
(74) *Attorney, Agent, or Firm* — Barley Snyder

(57) ABSTRACT

A stabilizing system for a deck system has a plurality of pedestals, a plurality of connection locations on a periphery of the pedestals and a stabilizing bar secured between the pedestals. The stabilizing bar includes a first half, a second half, a fastener, and a first securing member. The first half and the second half connect to each other and are extendable between at least two of the pedestals. The second half is sized to receive the first half therein in a telescoping manner. The fastener connects the first half with the second half, while the first securing opening extends from a bottom surface and is located near a respective end face opposite a juncture between the halves.

50 Claims, 5 Drawing Sheets

(56) References Cited

U.S. PATENT DOCUMENTS

| | | | | |
|---|---|---|---|---|
| 6,604,330 | B2 | 8/2003 | Repasky | |
| 6,754,992 | B1 * | 6/2004 | Byfield et al. | 52/36.5 |
| 7,650,726 | B2 * | 1/2010 | Jakob-Bamberg et al. | 52/263 |
| 2002/0078638 | A1 | 6/2002 | Huang | |
| 2002/0148173 | A1 | 10/2002 | Kugler | |
| 2004/0035064 | A1 | 2/2004 | Kugler et al. | |
| 2008/0053017 | A1 | 3/2008 | Hockemeyer et al. | |
| 2008/0053018 | A1 | 3/2008 | Hockemeyer et al. | |
| 2008/0222973 | A1 | 9/2008 | Lee et al. | |

OTHER PUBLICATIONS

Wausau Tile, "Terra System One Level Installation, Terr-Adjust System", (http://www.wausautile.com), Apr. 3, 2009.

Wausau Tile, Terra System One Level Installation (Terra-Stand System), (http://www.wausautile.com), Apr. 3, 2009.

Westile, "Pedestals", (http://www.westile.com/pedestal.asp?img=13&cat=comm&ped=acc), Apr. 3, 2009.

Westile, Screwjack Pedestals, (http://www.westile.com), Dec. 2006.

* cited by examiner 26
63
65
86
84
80
82

94
93
92
86
84
98
96
82
90
93
86
94
63
65
63
65

STABILIZING SYSTEM FOR DECK PEDESTALS

CROSS-REFERENCE TO RELATED APPLICATIONS

This application is a continuation of U.S. patent application Ser. No. 12/417,942, filed Apr. 3, 2009 now U.S. Pat. No. 8,381,461.

FIELD OF THE INVENTION

The present invention relates generally to pedestals for deck systems and more particularly to a stabilizing bar for such deck systems.

BACKGROUND

Roof structures of many buildings are capable of supporting a substantially horizontal surface, or deck, enabling the construction of roof terraces, pedestrian walkways, roof gardens, plaza decks, sun decks, balconies, patios or the like. Such roof surfaces are often formed at a slight slope relative to horizontal for drainage purposes. Typically, the roof surface itself is not constructed of a material that provides a suitable traffic bearing surface nor is it aesthetically pleasing.

Examples of deck systems utilizing roof pavers, or ballast blocks, are disclosed by U.S. Pat. Nos. 5,887,397; 5,377,468; 5,442,882; and 6,604,330 B2 issued to Repasky. Also see U.S. Pat. Nos. 4,570,397 issued to Creske; and 5,588,264 and 6,332,292 B1 issued to Buzon.

While the rooftop ballast block deck systems disclosed in the above referenced patents may be satisfactory for their intended purposes, there is a need, especially with systems using height adjustable pedestals, for stabilizing systems. Such stabilizing systems are needed to minimize movement of the ballast block deck systems which they support.

SUMMARY

In view of these needs, the present invention provides a stabilizing system which restrains relative movement of the pedestals it supports. The stabilizing system has a plurality of connection locations on a periphery of the pedestals and a stabilizing bar secured between the pedestals. Each of the pedestals supports corner portions of adjacent blocks, pavers or panels a spaced distance above an underlying structure extending generally parallel to the blocks, pavers or panels. The stabilizing bar is secured to and extends between the connection locations of at least two of the pedestals.

The stabilizing bar includes a first half, a second half, a fastener, and a first securing member. The first half and the second half connecting to each other and extendable between at least two of the pedestals. The second half is sized to receive the first half therein in a telescoping manner. The fastener connects the first half with the second half, while the first securing opening extends from a bottom surface and is located near a respective end face opposite a juncture between the halves.

BRIEF DESCRIPTION OF THE DRAWINGS

The features and advantages of the present invention should become apparent from the following description when taken in conjunction with the accompanying drawings, in which.

DETAILED DESCRIPTION OF THE EMBODIMENT(S)

Figure 1:
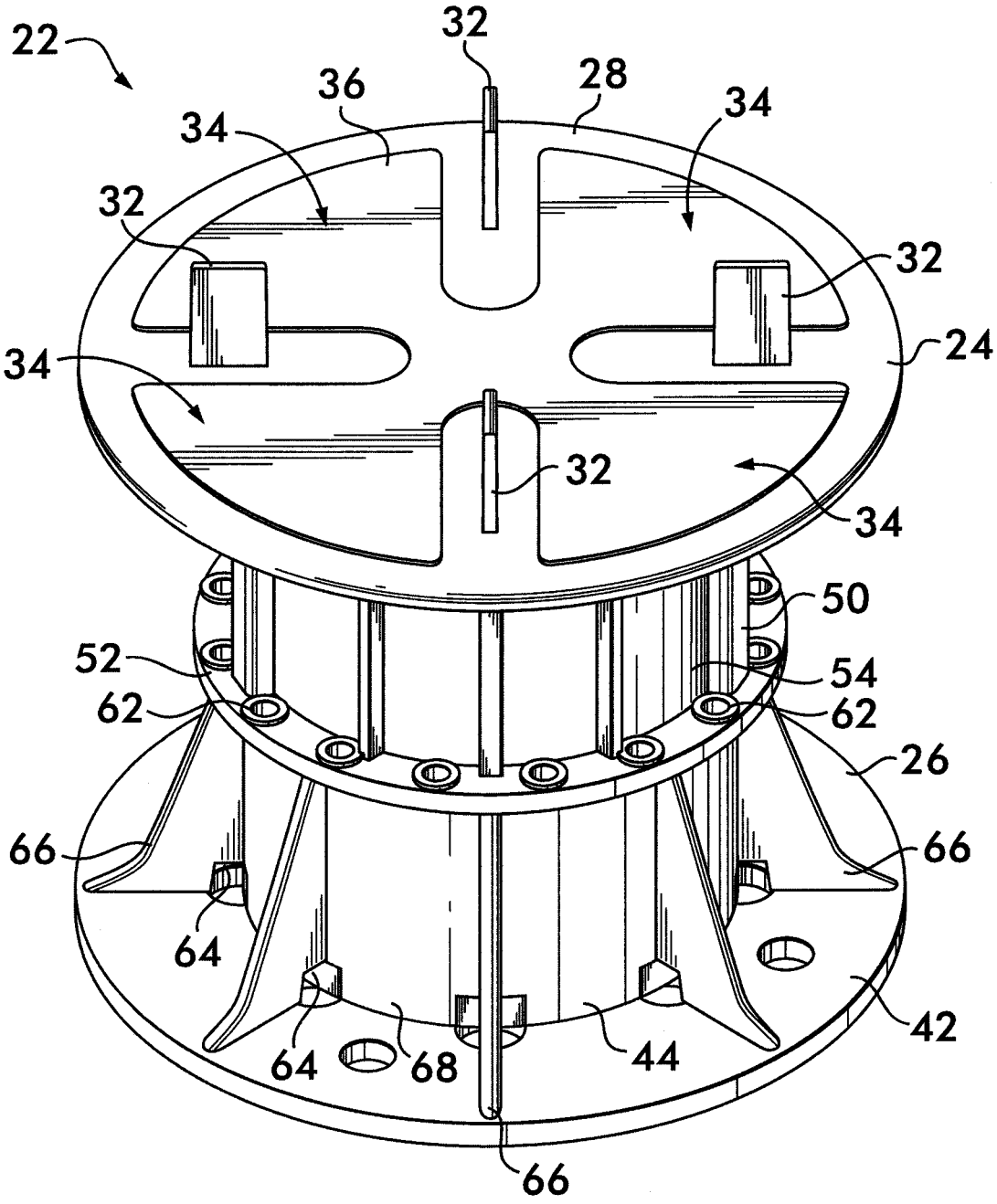
FIG. 1 is a perspective view of a pedestal embodying the present invention.

Referring now to the drawings, a deck 10 is constructed of a plurality of separate, substantially-rectangular pavers, ballast blocks, or panels 12 (hereinafter referred to as blocks) that are arranged in a grid layout, or pattern, and that are supported a spaced distance above a surface, such as an exterior roof surface 14 of a building. The deck 10 provides a substantially level traffic-bearing surface 16 for pedestrians and an aesthetic appearance. It can be used to convert an otherwise unusable rooftop or like space into a useful area.

Each block 12 can be made of concrete, marble, granite, wood, rubber, plastic, composite materials, or like weight-bearing substance and is typically square, rectangle, or some other shape that can be positioned in uniform patterns. Thus, each block 12 will typically have corner portions 18, and the deck 10 will have intersection areas 20 in which corner portions 18 of adjacent blocks 12 extend. A separate pedestal 22 underlies each intersection area 20 and supports the corner portions 18 of the adjacent ballast blocks 12. Thus, the entire deck 10 is elevated from an underlying structure, such as exterior roof surface 14 which extends and lies generally parallel to the deck 10. The spacing provided between the blocks 12 and surface 14 and between the laterally positioned blocks 12 permits proper drainage of fluids, such as rain, through the deck 10.

As best illustrated in FIG. 1, each pedestal 22 includes a support 24 at an upper end thereof and a base 26 at a lower end thereof. The presence of an intermediate coupler 50, as shown in FIG. 1, is optional. In its simplest form, the pedestal 22 can consist solely of the support 24 and base 26 without an intermediate coupler 50. The support 24 and base 26 are preferably manufactured separately and may be molded of plastic. The support 24 and base 26 interconnect in a manner permitting an overall height of the pedestal 22 to be adjusted. More specifically, the action of rotating the support 24 relative to the base 26 causes the height of the pedestal 22 to be altered. Thus, the height of each pedestal 22 in the deck 10 can be readily adjusted, as required, during installation of the deck 10 and/or during maintenance thereof.

In the illustrated embodiment, the support 24 includes a plate 28 with a substantially cylindrical post 30 depending therefrom. In use, the plate 28 is disposed in a substantially horizontal position thereby providing a surface on which the corner portions 18 of the blocks 12 can be supported. Preferably, a plurality of upstanding walls 32 project from the plate 28 and define separate quadrants 34 on the plate 28. Each quadrant 34 receives one corner portion 18 of a block 12. The walls 32 align the corner portions 18 on the pedestal 22 and define lateral spacing between adjacent blocks 12 to permit rain water and other fluids to drain through the deck 10 and around the outside of plate 28.

Figure 2:
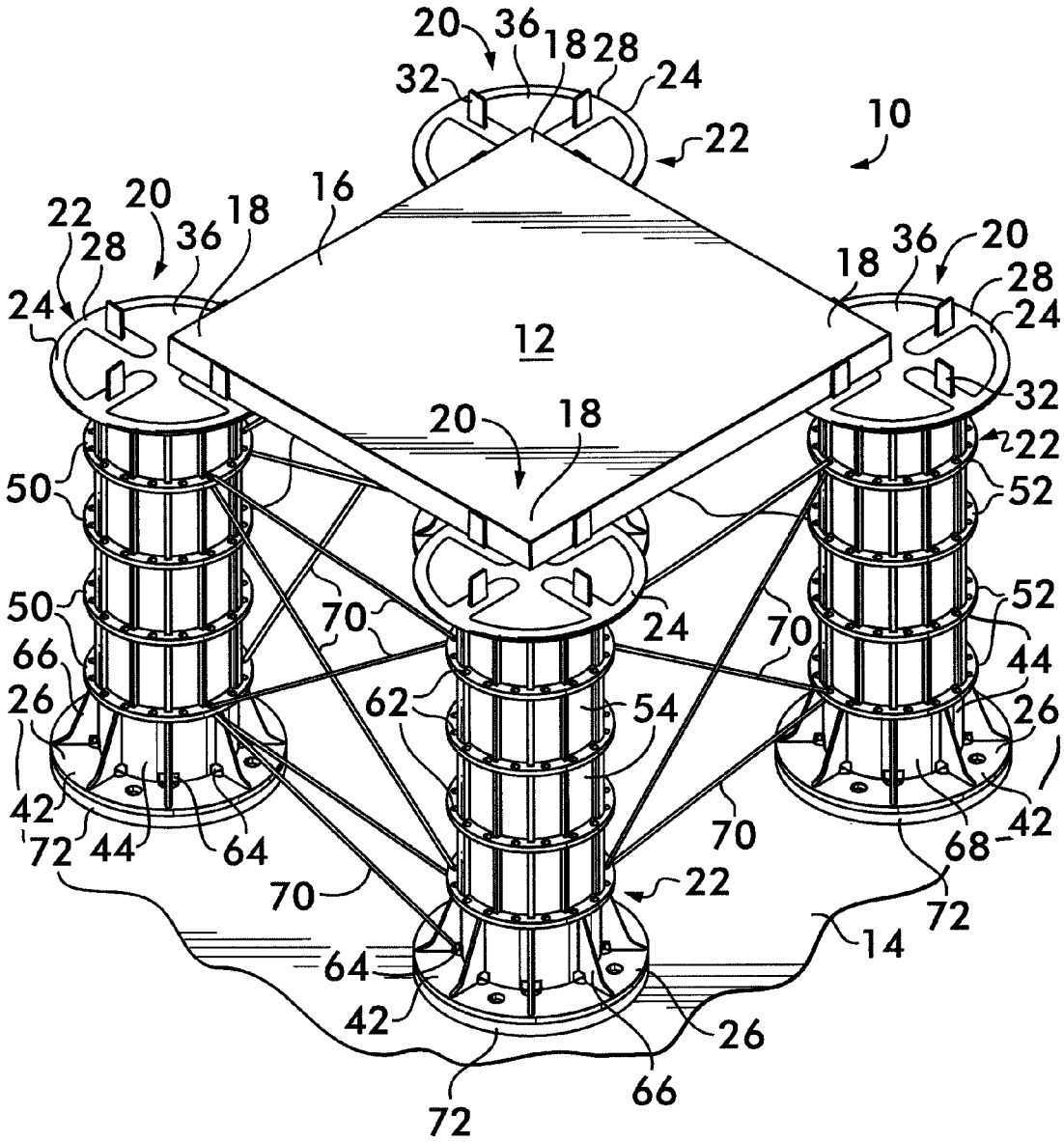
FIG. 2 is a perspective view of a part of a deck system having cross bracing between adjacent pedestals according to the present invention.

One or more couplers 50 can be assembled between the support 24 and base 26 to add further height to the pedestal 22. For example, FIG. 2 shows the use of a couplers 50. Each coupler 50 is identical and separately manufactured from preferably the same material as the support 24 and base 26.

Each coupler 50 includes a flange, or collar 52, from which a substantially cylindrical, hollow post 54 projects and a substantially cylindrical post 56 depends. In this configuration, the flange 52 extends circumferentially about a mid-section of the coupler 50 and extends laterally therefrom. Continuous or discontinuous spiral threads 8 are provided on an inner surface of the hollow post 54 and are capable of cooperatively engaging threads on a post 30 of the support 24. In addition, continuous or discontinuous spiral threads are provided on an outer surface of the hollow post and are capable of cooperatively engaging the threads on post of the base 26. Accordingly, the coupler 50 can be used to interconnect the support 24 to the base 26. Further, the couplers 50 are designed to interconnect to each other so that multiple couplers 50 can be interconnected between the support 24 and the base 26. Rotation of the couplers 50, support 24, and base 26 relative to each other can be used to adjust the overall height of the pedestal 22.

Preferably, the flange 52 of each coupler 50 extends in a plane that is substantially parallel to the support plate 28 and base plate 42. See FIG. 1. In the illustrated embodiments, the flange 52 is annular; however, it could be of any shape in plan. In addition, the support plate 28 may be of a similar size, in plan, to that of the base plate 42. For example, both plates 28 and 42 can be provided in a circular shape, in plan, having substantially identical diameters. Alternatively, the plates, 28 and 42, and the flange 52 can be of different shapes and sizes.

The flange 52 preferably has a series of connection locations 62 which in this embodiment are formed as eyelets extending therethrough. For instance, the connection locations 62 can be provided as apertures that are circumferentially spaced-apart about the mid-section of the coupler 50. The connection locations 62 as shown in FIG. 1. may include optional reinforcements which extend around the aperture and outward from the flange surface. In the illustrated embodiment, sixteen separate connection locations 62 are equally spaced-apart about the coupler 50. Fewer or more connection locations 62 can be provided on the annular flange 52. The connection locations 62 are used for securing the ends of bracing wires to the pedestal 22. The uniform distribution of closely-spaced connection locations 62 about the coupler ensures that a connection location 62 will always be opposed to an connection location 62 in an adjacent pedestal 22 thereby enabling ease of installation of the bracing. Thus, connection locations 62 should be readily available at most or substantially all locations about the coupler for ready coupling of bracing wires between pedestals. The bracing should not be required to be bent or the like due to the unavailability of connection locations 62 and should not generate forces that may cause undesired rotation of any components of the pedestals 22.

The base 26 can also be provided with brace securement eyelets 64. For example, each base 26 can have a plurality of reinforcement walls 66 that extend radially-from an exterior 68 of the post 44. The walls 66 can be spaced-apart circumferentially about the post 44 and can extend integrally from both the plate 42 and post 44 of the base 26. Connection locations 64 can be provided in the walls 66. In the illustrated embodiment, the connection locations 64 are provided adjacent an area on the base 26 where the post 44 interconnects with the plate 42.

As best shown in FIG. 2, a stabilizing system for the deck system may include cross bracing that ties adjacent pedestals 22 together and restrains their movement relative to one another. It should be noted here that the cross bracing, imparts a degree of rigidity over the entire height of the system between the surface 14 and the blocks 12. The bracing can include elongate wires, wire rope, cable or rods, 70 that are secured to adjacent pedestals 22. The bracing 70 can extend substantially horizontal or can extend at angles to the horizontal whereby the angular bracing imparts greater rigidity and stability in the area between the surface 14 and the blocks 12. For instance, X-bracing patterns can be utilized. The ends of the bracing wires 70 can be crimped and secured to the connection locations, 62 and 64, of the pedestals 22, and the wires 70 can extend coupler-to-coupler using connection locations 62 or base-to-coupler using connection locations 62 and 64.

Figures 3, 4:
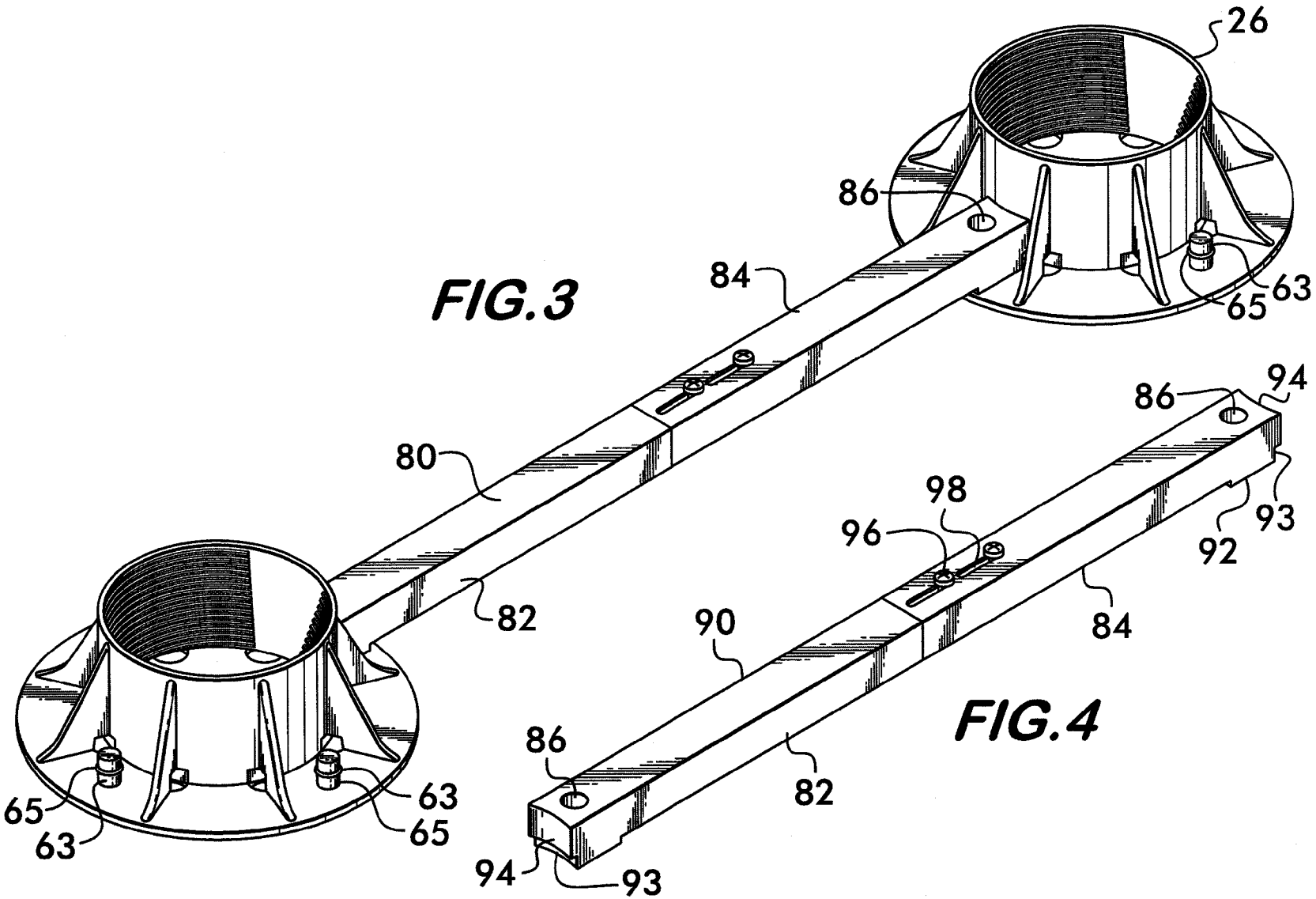
FIG. 3 is a perspective view of an alternate pedestal.
FIG. 4 is a top perspective view of stabilizer bar for use with the an alternate pedestal of FIG. 3.
Figure 4A:
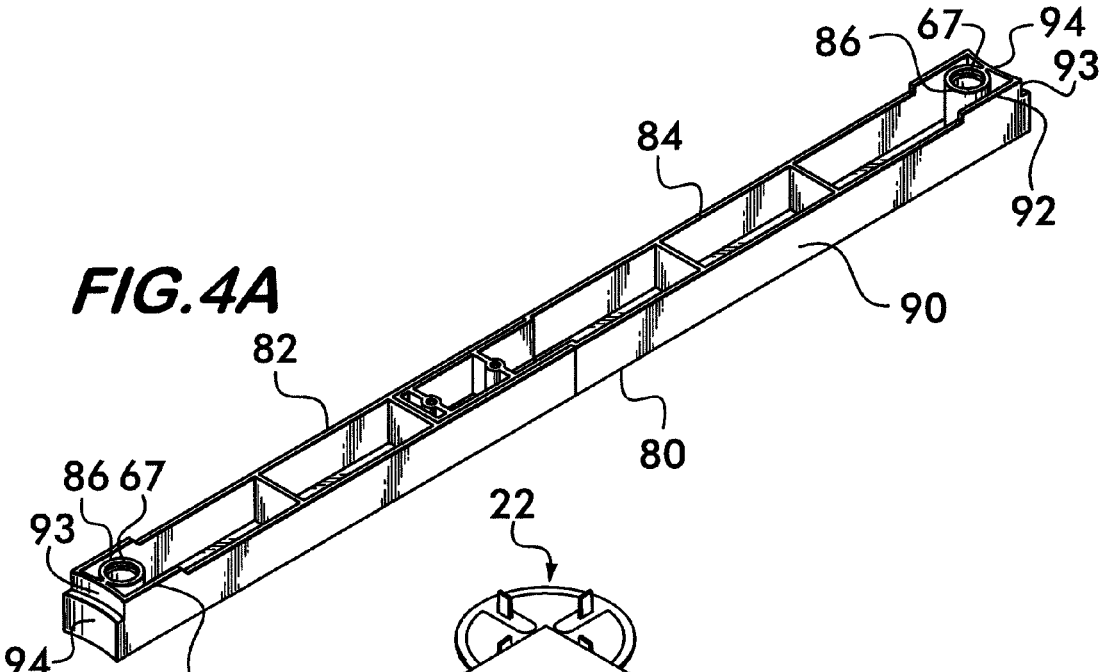
FIG. 4A is a bottom perspective view of stabilizer bar of FIG. 4.
Figure 5:
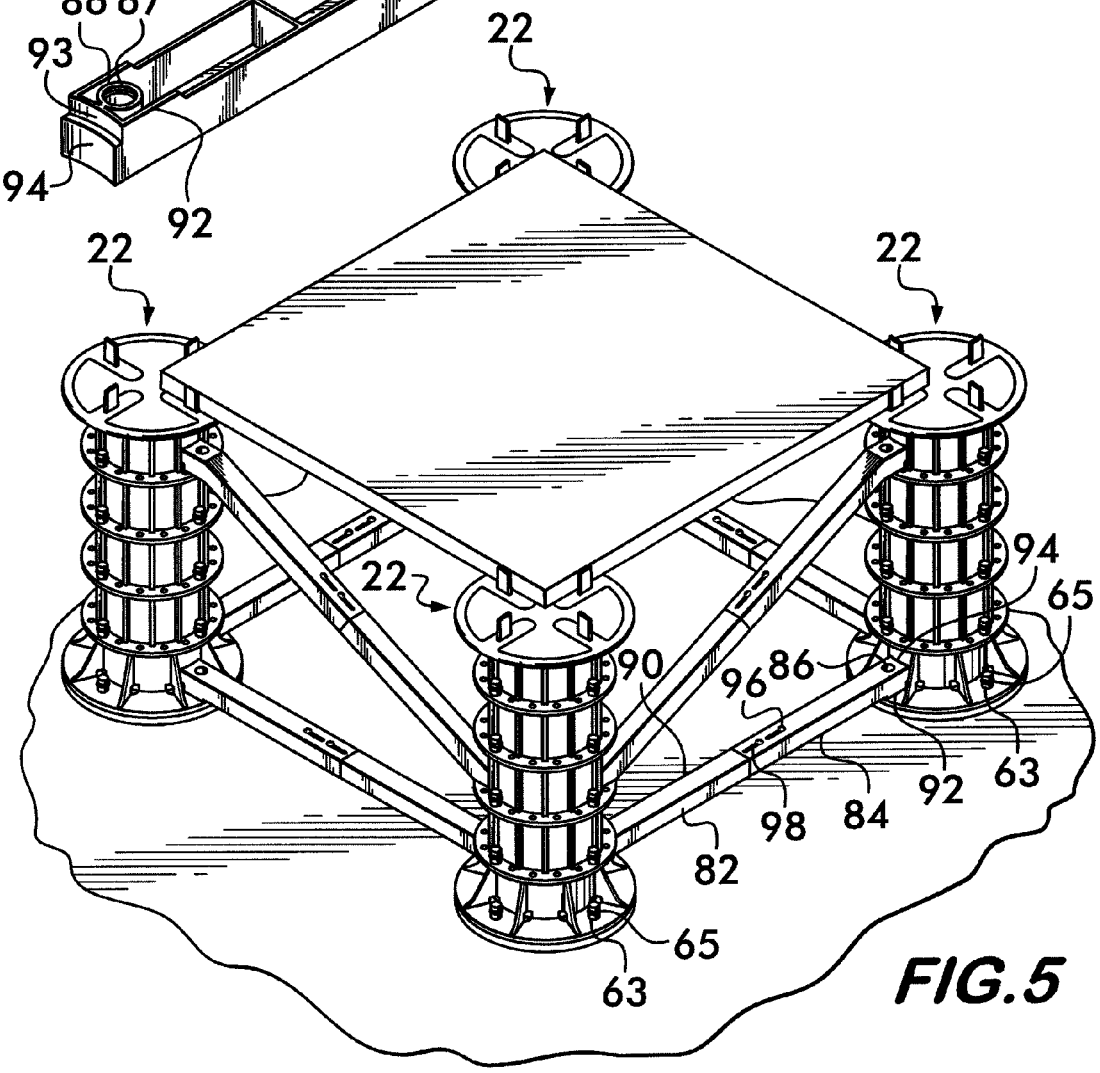
FIG. 5 is a perspective view of a part of a deck system having stabilizer bars between adjacent pedestals according to the present invention.

The stabilizing system may include a stabilizing bar 80 utilized in place of the elongate wires, wire rope, cable or rods 70. Such stabilizing bars 80 extend substantially horizontally or at angles to the horizontal between adjacent pedestals 22 as best shown in FIG. 5. The stabilizing bar 80 will now be described in greater detail with reference to FIGS. 3, 4 and 4A. The stabilizing bar 80 is formed of two telescoping halves 82, 84. Each of the telescoping halves 82, 84 are connected to each other through a telescoping arrangement wherein the first half 82 an extension The first half 82 further includes at least one projection or fastener 96 such as a screw, bolt, snap or latching projection or any other suitable fastener located along a top surface 91. The fastener 96 is positioned along the top surface 91 to engage a securing slot 98 located along the top surface 91 of the second half 84. The securing slot 98 shown here to be generally oval in shape, may be optionally profiled to have a wider portion for receiving the projection or fastener 96 and a narrower portion into which the projection or fastener 96 slides to secure it in the slot 98. The telescoping nature along with the slot and fastener arrangement allows the stabilizing bar 80 to be adjustable in length between end faces 94. The adjustment facilitates use with various size blocks 12 or facilitates adjustment that may be necessary because of block size variances within tolerances. As an alternative, the stabilizing bar 80 may be one piece formed of an appropriate length without telescoping halves. The end faces 94 are contoured to complement the end surface of the pedestal base 26 which it engages. The top and bottom surfaces 91, 92 extend between the end faces 94. It should be understood by those reasonably skilled in the art that while the top and bottom surfaces 91, 92 are shown here as being either a flat or contoured, any suitable contour for either surface is within the spirit of the invention. Here, in this exemplary embodiment, the bottom surface 92 is shown to have a contour which allows water and/or debris to flow thereunder for better drainage. The contour has a raised portion in the mid-section or center of the stabilizing bar 80 with steps located near the end faces 94 which engage the base 26. Adjacent to each end face 94, a securing opening 86 extends between the top and bottom surfaces 91, 92. The securing opening may optionally extend from the bottom surface 92 up toward a closed end near the top surface 91 to form a blind hole. The securing openings 86 are positioned to engage a connection location 63, in this embodiment, formed as a projection along the pedestal base 26 to secure the stabilizing bar 80 to the pedestal base 26. The projections 63 are profiled to have a draft angle or as shown in the example of FIG. 3, bump 65 for frictionally engaging the securing opening 86 thereon. Likewise, the securing openings 86 have a complementary inner profile with a draft or bump receiving recess 67 for frictionally engaging the projections 63. The profiles and complementary profiles may be arranged to have a tactile indication of securement such a click to indicate and ensure proper engagement between the pedestal base 26 and stabilizing bar 80. Although the projections 63 are shown here to be generally cylindrical, they may have other tubular shapes such as a rectangular or square tubular shapes or any shape which is capable of receiving a complementary shape of the securing opening 86. Also, although the projections 63 are shown here to be on the base 26 and the openings on the stabilizing bar 80, it will be understood by those reasonably skilled in the art that the connection arrangement may be reversed whereby the projections are located on the stabilizing bar 80 and the openings are located on the base 26.

Figure 6:
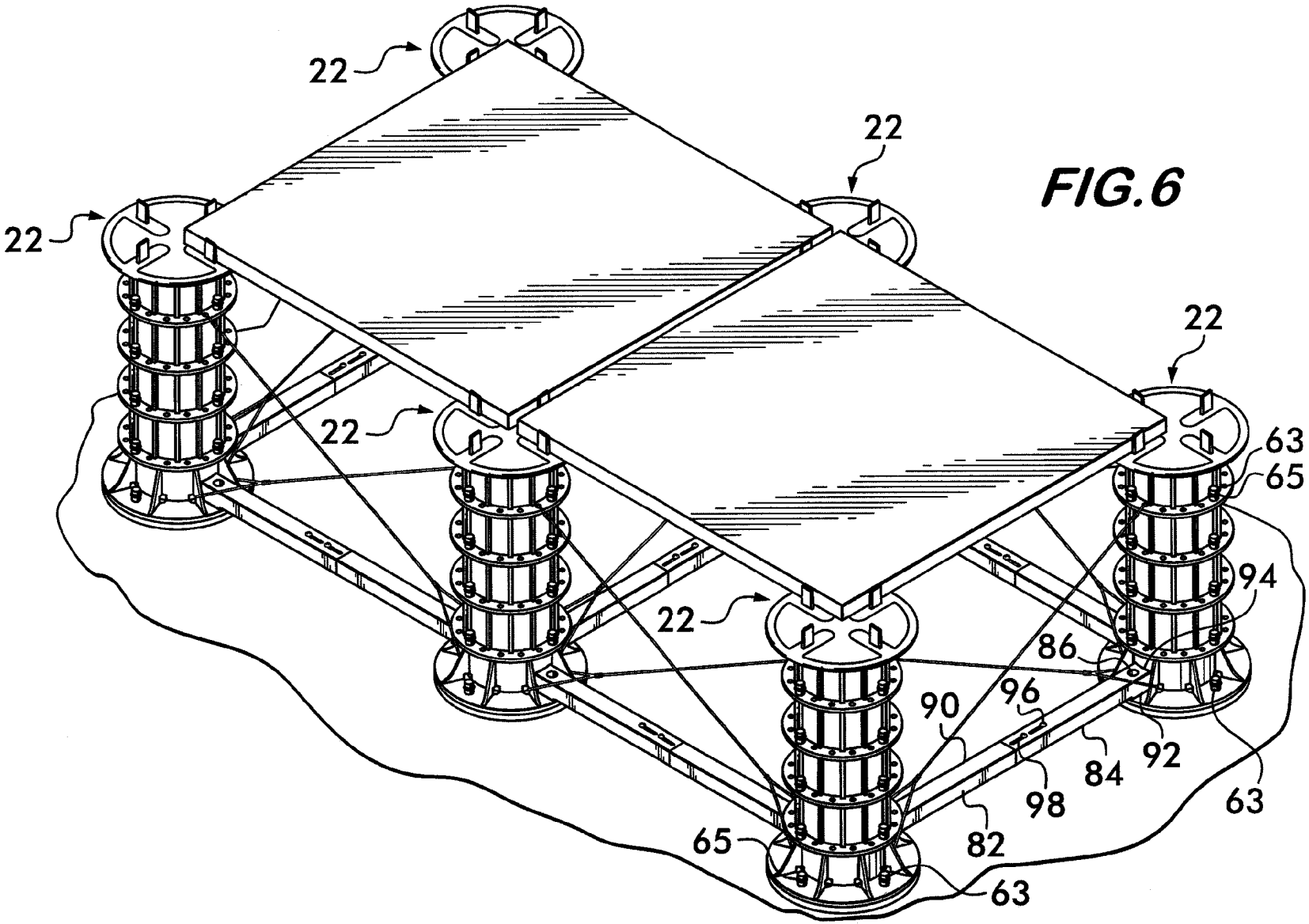
FIG. 6 is a perspective view of a part of a deck system having stabilizer bars and cross bracing between adjacent pedestals according to the present invention.

It should be understood by those reasonably skilled in the art that although FIG. 2 shows a stabilizing system having bracing wires 70 between connection locations 62, 64 and FIG. 4 shows a stabilizing system having stabilizing bars 80 between connection locations 63, any combination of such connection locations 62, 63, 64, bracing wires 70, and stabilizing bars 80, are possible and within spirit of the invention. Also, diagonal stabilizing bars may be formed in an X-pattern, either from two bars being interconnected or by a unitary X-shaped bar. Additionally, such bracing 70 or stabilizing bars 80 may be selectively applied or excluded as necessary. For example, FIG. 6 shows the bracing 70 excluded from the top horizontal locations adjacent to the block 12. A particular application may, for example, call for a stabilizing system suited to have a combination of stabilizing bars 80 located along bottom bases 26 and bracing wires 70 extending between supports 24 as best shown in FIG. 6. In that illustrative embodiment, stabilizing bars 80 are provided horizontally proximate to the underlying structure while wires 70 are located in locations as cross bracing above the stabilizing bars 80. The stabilizing bars 80 advantageously prevent movement of the pedestals 22 either toward or away from each other. As an alternative, best shown in FIG. 6., the wires 70 may be wrapped around the stabilizing bars 80 by passing the wire 70 trough each of two connection locations 64 adjacent to each side of the stabilizing bar 80. After being passed through both connection locations 64 the wire 70 is joined to itself above the stabilizing bar 80. The stabilizing bar 80, in that embodiment, may have optional notches 93 in the end faces 94 near the bottom surface 92 for passing the wires therethrough.

The above-described deck system and pedestal assembly according to the present invention provides a stable elevated traffic bearing surface for pedestrians and the like on an existing structure, such as rooftop. The deck is easy to install and inexpensive to manufacture. The height of each pedestal can be adjusted by rotating the support relative to the base or by adding or subtracting couplers. Cross bracing installed coupler-to-coupler and base-to-coupler in a manner preventing unwanted rotation of various components of the pedestal assembly.

While embodiments of a ballast block deck system and pedestal assembly have been described in detail, various modifications, alterations, and changes may be made without departing from the spirit and scope of the ballast block deck system and pedestal assembly according to the present invention as defined in the appended claims.

What is claimed is:

1. A stabilizing bar for connecting adjacent pedestals comprising:

a first part;

a second part sized to receive the first part therein such that the first part and the second part form an expandable shaft having:

(1) a body having opposing ends, (2) a pair of projecting end portions positioned near the opposing ends of the body, each of the pair of projecting end portions extending substantially perpendicular from a bottom surface of the body and engageable with a supporting surface of each of the connecting adjacent pedestals, and (3) a profiled portion having a raised portion in a substantial mid-section of the body and positioned between the pair of projecting end portions;

a fastener for connecting the first part with the second part;

a first securing opening extending through a bottom surface of one projecting end portion of the pair of projecting end portions and having a corresponding inner profile for frictionally engaging a projection integrally formed on one of the connecting adjacent pedestals, the first securing opening positioned and extending perpendicular to a longitudinal axis of the opposing ends, the first securing opening located near an end face of either part and opposite a juncture between the first and second parts; and a second securing opening extending from a bottom surface of another projecting end portion of the pair of projecting end portions located opposite the first securing opening.

2. The stabilizing bar of claim 1, wherein the first part and the second part connect and form a telescoping arrangement.

3. The stabilizing bar of claim 1, wherein the fastener projects from a top surface of the first part.

4. The stabilizing bar of claim 3, further comprising a slot formed in a top surface of the second part for receiving the fastener.

5. The stabilizing bar of claim 4, wherein the slot includes a wider portion for receiving the fastener and a narrower portion into which the fastener slides to secure it in the slot.

6. The stabilizing bar of claim 1, further comprising a slot formed in a top surface of the second part for receiving the fastener.

7. The stabilizing bar of claim 6, wherein the slot includes a wider portion for receiving the fastener and a narrower portion into which the fastener slides to secure it in the slot.

8. The stabilizing bar of claim 7, wherein the slot and the fastener connect and the stabilizing bar is adjustable in length using between the ends through the slot and the fastener.

9. The stabilizing bar of claim 1, wherein each part is a hollow reinforced piece of molded plastic.

10. The stabilizing bar of claim 1, wherein the first securing opening includes a bump receiving recess located along an inner surface thereof.

11. The stabilizing bar of claim 1, further comprising a notch formed in both ends near the bottom surface of the pair of projecting end portions.

12. The stabilizing bar of claim 1, wherein the first part and the second part are extendable between the connecting adjacent pedestals.

13. The stabilizing bar of claim 1, wherein the first part and the second part are angled between the connecting adjacent pedestals.

14. The stabilizing bar of claim 1, wherein each of the ends is contoured to complement an end surface of a connecting pedestal base.

15. The stabilizing bar of claim 1, further comprising an extension receiving channel on the second part and provided opposite the end face.

16. The stabilizing bar of claim 15, further comprising an extension provided on the first part and connecting with the extension receiving channel.

17. The stabilizing bar of claim 16, further comprising a slot formed in the extension receiving channel for receiving the fastener.

18. The stabilizing bar of claim 1, whereby a bottom surface of the raised portion is positioned above the bottom surface of the pair of projecting end portions.

19. The stabilizing bar of claim 1, whereby the profiled portion is open along opposite lateral sides of the body.

20. The stabilizing bar of claim 1, whereby a height between a top surface of the body and a bottom surface of the profiled portion is less than a height of the top surface of the body and a bottom surface of the pair of projecting end portions.

21. A stabilizing bar for connecting adjacent pedestals comprising:

a first part;

a second part sized to receive the first part therein in a telescoping manner such that the first part and the second part form an expandable shaft having (1) a body, (2) a profiled portion having a raised portion in a substantial mid-section of the body; and (3) a pair of projecting end portions positioned near opposing ends of the expandable shaft and engageable with the connecting adjacent pedestals and having steps engageable with a supporting surface of each of the connecting adjacent pedestals, whereby a height between a top surface of the body and a bottom surface of the profiled portion is less than a height between a to surface of the body and a bottom surface of the pair of projecting end portions; and a fastener projecting from the top surface of the first part;

a slot formed in the top surface of the second part for receiving the fastener; and a pair of securing openings extending from the bottom surface of each the pair of projecting end portions and positioned perpendicular to a longitudinal axis of the opposing ends, the pair of securing openings located opposite from each other and near a respective end face opposite a juncture between the first part and the second part;

wherein the pair of securing openings are each profiled to frictionally engage a projection integrally formed on a flange positioned between a top support of one of the connecting adjacent pedestals.

22. The stabilizing bar of claim 21, wherein the pair of securing openings are each profiled to have a bump receiving recess located along an inner surface thereof.

23. The stabilizing bar of claim 21, further comprising a notch formed in each of the pair of projecting end faces near the bottom surface for passing a securing wire therethrough.

24. The stabilizing bar of claim 21, wherein each of the pair of projecting end portions is a stepped like part extending from a main body of the expandable shaft.

25. A stabilizing bar according to claim 21, whereby a bottom surface of the raised portion is positioned above the bottom surface of the pair of projecting end portions.

26. The stabilizing bar of claim 21, whereby each of the pair of projecting end portions extend below a bottom surface of the body.

27. The stabilizing bar of claim 21, whereby the profiled portion is open along opposite lateral sides of the body.

28. The stabilizing bar according to claim 21, whereby the profiled portion is positioned between the pair of projecting end portions.

29. A stabilizing bar for connecting adjacent pedestals comprising:

an elongated body having:

a first securing opening extending from a bottom surface and located near an end face of the elongated body and a second securing opening extending from the bottom surface and located opposite the first securing opening at another end face;

a profiled portion having a raised portion in a substantial mid-section of the elongated body; and a pair of projecting end portions positioned near opposing end faces of the elongated body and engageable with the connecting adjacent pedestals and having steps located at opposite ends of the raised portion whereby the raised portion is open along opposite lateral sides of the elongated body;

wherein the first and second securing openings are positioned perpendicular to a longitudinal axis of the end faces.

30. The stabilizing bar of claim 29, wherein the elongated body is adjustable in length between the connecting adjacent pedestals.

31. The stabilizing bar of claim 29, wherein the elongated body is a hollow reinforced piece of molded plastic.

32. The stabilizing bar of claim 29, wherein the first securing opening includes a bump receiving recess located along an inner surface thereof.

33. The stabilizing bar of claim 32, wherein the second securing opening includes a bump receiving recess located along an inner surface thereof.

34. The stabilizing bar of claim 29, further comprising a notch formed in the end face near the bottom surface.

35. The stabilizing bar of claim 29, wherein the end faces are angled between the connecting adjacent pedestals.

36. The stabilizing bar of claim 29, wherein the raised portion is disposed between the pair of projecting end portions.

37. The stabilizing bar of claim 29, wherein each end face is contoured to complement an end surface of a connecting pedestal base.

38. The stabilizing bar of claim 1, wherein the profiled portion extends between and from the pair of projecting end portions to an upper surface of the expandable shaft.

39. The stabilizing bar of claim 1, wherein each of the pair of projecting end portions is a stepped like part extending from a main body of the expandable shaft.

40. The stabilizing bar of claim 29, wherein each of the pair of projecting end portions is a stepped like part extending from the elongated body.

41. A stabilizing bar according to claim 29, whereby a bottom surface of the raised portion is positioned above a bottom surface of the pair of projecting end portions.

42. The stabilizing bar of claim 29, whereby each of the pair of projecting end portions extend substantially perpendicular from a bottom surface of the elongated body.

43. The stabilizing bar of claim 29, whereby a height between a top surface of the elongated body and a bottom surface of the profiled portion is less than a height between the top surface of the elongated body and a bottom surface of the pair of projecting end portions.

44. The stabilizing bar according to claim 29, whereby the profiled portion is positioned between the pair of projecting end portions.

45. A stabilizing bar for connecting adjacent pedestals comprising:

an elongated body; and a pair of projecting end portions positioned at opposing end faces of the elongated body and extending substantially perpendicular with respect to a longitudinal axis of the elongated body to provide a profiled portion with a raised portion having a bottom surface positioned above the bottom surface of the pair of projecting end portions and having elongated openings disposed along lateral sides thereof and extending between the pair of projecting end portions, each of the pair of projecting end portions having:

a stepped like part extending from the raised portion which engages a flange surface extending from a post of one of the connecting adjacent pedestals;

a contoured end face positioned substantially perpendicular to the stepped like part and curved to correspond to a profile of the post; and a pair of securing openings extending from a bottom surface of the elongated body and engageable with protuberances disposed on the flange and extending substantially parallel to the post.

46. The stabilizing bar of claim 45, wherein the elongated body is adjustable in length between the connecting adjacent pedestals.

47. The stabilizing bar of claim 45, wherein the elongated body is a hollow reinforced piece of molded plastic.

48. The stabilizing bar of claim 45, wherein each one of the pair of securing openings includes a bump receiving recess located along an inner surface thereof.

49. The stabilizing bar of claim 45, further comprising a notch formed in an end face of each one of the pair of projecting end portions.

50. The stabilizing bar of claim 45, wherein the profiled portion is a narrowing of the elongated body which occurs between the pair of projecting end portions.

* * * * *

UNITED STATES PATENT AND TRADEMARK OFFICE

CERTIFICATE OF CORRECTION

PATENT NO. : 8,667,747 B2
APPLICATION NO. : 13/032995
DATED : March 11, 2014
INVENTOR(S) : John Repasky It is certified that error appears in the above-identified patent and that said Letters Patent is hereby corrected as shown below:

In the Claims

In column 6, line 53, "between the ends through" should be removed.

Signed and Sealed this
Ninth Day of September, 2014

Michelle K. Lee

Michelle K. Lee
*Deputy Director of the United States Patent and Trademark Office*